US008528574B2

(12) United States Patent
Jerg et al.

(10) Patent No.: US 8,528,574 B2
(45) Date of Patent: Sep. 10, 2013

(54) DEVICE FOR CONTROLLING SPRAY CHANNELS IN DISHWASHER MACHINES

(75) Inventors: Helmut Jerg, Giengen (DE); Hans-Peter Nannt, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1519 days.

(21) Appl. No.: 10/578,386

(22) PCT Filed: Nov. 4, 2004

(86) PCT No.: PCT/EP2004/052797

§ 371 (c)(1),
(2), (4) Date: May 3, 2006

(87) PCT Pub. No.: WO2005/044071

PCT Pub. Date: May 19, 2005

(65) Prior Publication Data

US 2007/0079850 A1 Apr. 12, 2007

(30) Foreign Application Priority Data

Nov. 6, 2003 (DE) ..... 103 51 785 U

(51) Int. Cl.
*A47L 15/42* (2006.01)
*A47L 15/16* (2006.01)

(52) U.S. Cl.
USPC ..... 134/103.2; 134/199; 134/183

(58) Field of Classification Search
USPC ..... 134/103.2
See application file for complete search history.

(56) References Cited

U.S. PATENT DOCUMENTS

| | | | | | |
|---|---|---|---|---|---|
| 1,623,203 | A | | 4/1927 | Patterson | |
| 2,239,110 | A | * | 4/1941 | Mahoney | 134/172 |
| 2,654,894 | A | * | 10/1953 | Van Dijck | 4/615 |
| 3,512,539 | A | * | 5/1970 | Hamilton | 134/136 |
| 3,936,851 | A | | 2/1976 | Wareham | |
| 5,409,026 | A | | 4/1995 | St. Martin | |
| 6,003,529 | A | * | 12/1999 | Perry, Jr. | 134/56 D |

FOREIGN PATENT DOCUMENTS

| | | | |
|---|---|---|---|
| CH | 571 852 | | 1/1976 |
| CH | 571852 | * | 1/1976 |
| CH | 592 436 | | 10/1977 |
| DE | 1 847 897 | | 3/1962 |

(Continued)

OTHER PUBLICATIONS

International Search Report PCT/EP2004/052797.

*Primary Examiner* — Michael Kornakov
*Assistant Examiner* — Jason P Riggleman
(74) *Attorney, Agent, or Firm* — James E. Howard; Andre Pallapies

(57) ABSTRACT

A dishwasher machine with a compact device for spraying items to be rinsed is provided whereby the rinsing liquid is regularly sprayed in the rinsing container and the spray jets created by the spray device can be varied. To this end, the rinsing device comprises at least one spray channel which guides a rinsing liquid and comprises, on a side thereof facing the inside of the rinsing container, openings for the rinsing liquid and two open ends via which rinsing liquid can be supplied in a pressurized manner. At least one distributor is provided for regulating the supply of rinsing liquid to the spray channel in lieu of conventional mobile components such as spray arms, and various spray patterns can be produced by means of the distributor, improving the cleaning action of the dishwasher machine.

32 Claims, 1 Drawing Sheet

(56) References Cited

FOREIGN PATENT DOCUMENTS

| | | | |
|---|---|---|---|
| DE | 1940 574 | | 2/1971 |
| DE | 84 34 858 | | 4/1985 |
| DE | 298 09 680 | | 8/1998 |
| FR | 2 285 838 | | 4/1976 |
| FR | 2285838 | * | 4/1976 |
| GB | 949954 | * | 2/1964 |
| GB | 2003840 A | * | 3/1979 |

* cited by examiner

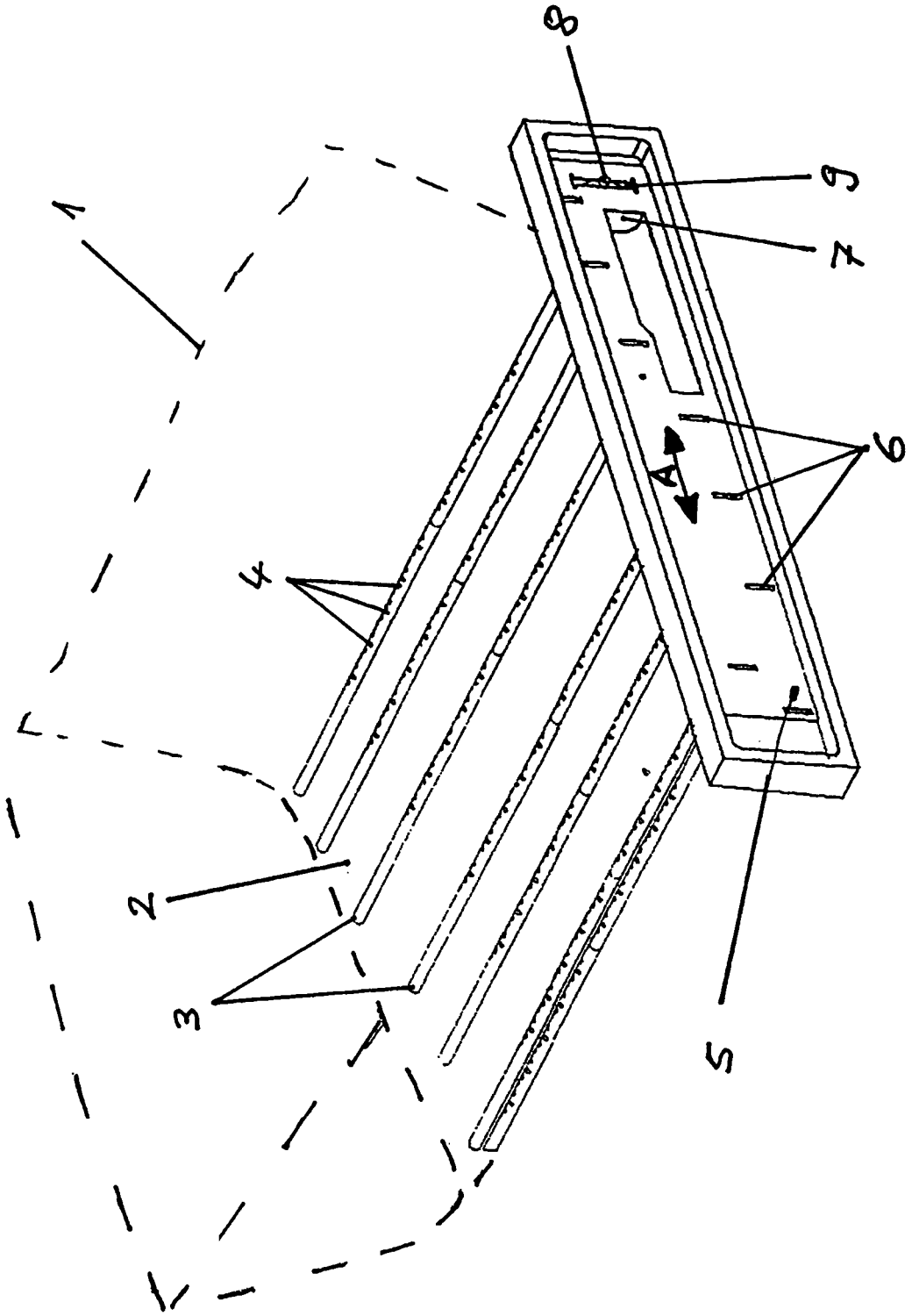
8
9
7
1
6
A
4
2
3
5

DEVICE FOR CONTROLLING SPRAY CHANNELS IN DISHWASHER MACHINES

The subject matter of the invention is a dishwasher machine with spray channel for spraying items to be rinsed with rinsing liquid and especially a device for controlling these spray channels.

BACKGROUND OF THE INVENTION

Dishwashers with spray devices which operate with rotating spray arms are known. Since the rinsing container in conventional dishwashers usually has a rectangular outline, whereas the rotating spray arms have a circular range of action, the respective corner areas can only be inadequately sprayed with rinsing liquid by the rotating spray arms. In addition, rotating spray arms have the disadvantage that the rotation of the spray arm can be hindered, for example, by items to be sprayed which have entered into the movement range of the spray arm.

Furthermore, dishwashers with spray devices are known in the prior art wherein the items to be rinsed located in the rinsing container are acted upon by rinsing liquid by means of fixed spray nozzles or sprinklers. These spray devices have the disadvantage that they project into the interior of the rinsing container and thereby reduce the space in the rinsing container which can be used for the arrangement of items to be rinsed. Furthermore, the known spray devices only produce uniform spray jets which is disadvantageous for the cleaning effect of the items to be rinsed.

SUMMARY OF THE INVENTION

It is thus the object of the present invention to provide a dishwasher with a space-saving device for spraying items to be rinsed wherein the rinsing liquid is, on the one hand, sprayed in the rinsing container as uniformly as possible to efficiently act upon the items to be rinsed with rinsing liquid and on the other hand the spray jets produced as variable in order to improve the cleaning effect of the items to be rinsed.

This object is solved by the device according to the invention having the features according to the disclosed exemplary embodiments.

The dishwasher according to the invention has at least one rinsing container and a spray device for spraying rinsing liquid into the interior of the rinsing container wherein the spray device comprises at least one spray channel which guides a rinsing liquid, which has openings for passage of the rinsing liquid on a side directed towards the interior of the rinsing container and two open ends via which rinsing liquid can be supplied in a pressurised manner, wherein at least one distributor is provided for regulating the supply of rinsing liquid to the spray channel.

An advantage of the dishwasher with a spray device according to the present invention is that no moving components such as spray arms, for example, are required to distribute the rinsing liquid in the rinsing container, thereby eliminating any motion-induced liability to breakdown of moving parts in the rinsing container. This has the consequence that, for example, any falling items of crockery no longer disturb the spray distribution of the rinsing liquid since no more mechanically moving parts are present in the rinsing container whose range of movement could be impeded.

As a result of eliminating the need for rotating spray arms, the advantage is furthermore obtained that the space in the rinsing container which can be used to arrange items to be rinsed is enlarged. The crockery items can be disposed extremely close to the bottom, top or wall area since free space for movement of a rotating spray arm no longer needs to be taken into account. In addition, the freedom in the arrangement of the crockery baskets located in the rinsing container is also greater since no space requirements needs to be taken into account for rotating spray arms or components for distributing the rinsing liquid which project from the bottom, top or wall areas of the rinsing container.

The advantage of controlling the spray device by means of a distributor in the dishwasher according to the invention is that the spray device not only produces uniform spray jets but by regulating the supply of rinsing liquid supplied to the spray channel by the distributor it is also possible to produce different spray patterns which improves the cleaning effect of the dishwasher machine. The spray patterns can also be configured as variable with time.

Another advantage of the spray device of the dishwasher according to the invention is that the length and width of the spray container no longer need to be constructed as approximately in the ratio of 1:1, as is required, for example, in the case of a spray device with rotating spray arms, but it can be configured in almost any shape since the spray channels can be correspondingly adapted to any shape of the rinsing container.

The pressure build-up and the pressure build-up of the rinsing liquid supplied to the spray channel is regulated by the distributor. In this way, the intensity of the spray jets emerging from the spray channels can be varied. Since the spray channels each have two open ends, rinsing liquid can be supplied to the spray channels from both sides under different pressurisation in order to obtain a "moving jet" or a spray pattern. Thus, spray pressure maxima can migrate from one end of the spray channel to its other end.

The spray patterns are formed by the different pressure distribution of the rinsing liquid in the spray channel which is obtained as a result of the time variation of the pressure at which the rinsing liquid is supplied via the two ends of the spray channel where the liquid pressure produced at one end of the spray channel by means of the distributor is different from the liquid pressure produced at the other end of the spray channel. As a result, jets of rinsing liquid of different strength emerge at different pressure from the openings of the spray channel in the interior of the rinsing container. The supply of rinsing liquid to the spray channel at variable pressure, i.e. by means of a pressure sequence and pressure control monitored by the distributor consequently makes it possible to produce different spray patterns, which can be adapted to specific items to be rinsed or degrees of contamination, for example.

Loss of flow is minimized by controlling the spray channels by means of the distributor directly before the entrance to the jet tube. For this purpose, the spray channels are preferably coupled by means of detachable connecting elements at both ends to the distributor and thereby connected to the rinsing liquid cycle, especially to the circulating pump. A plurality of spray patterns can be provided by means of a corresponding rinsing program selection where it is also possible to take into account the type and different contamination states of the items to be rinsed in the selection of spray patterns.

The spray channels each have two open ends where the open ends of the spray channels on one side are coupled to a first distributor and the open ends of the spray channels on the opposite side are coupled to a second distributor. Both the spray intensity and also the spray pattern is preferably regulated by means of a controlled pressure sequence and pressure control by means of the distributor. In this case, a plurality of different spray patterns can be generated according to a choice of rinsing program. It is possible to take into account the different contamination states and the type of items to be rinsed when selecting the spray patterns.

In a further preferred embodiment of the dishwasher machine with a spray device according to the present invention, the distributor is arranged so that it can be moved and preferably can be displaced in a to-and-fro movement in alternating direction. For example, the at least one distributor can be mounted to be movable relative to the spray channels in a selected one of a to-and-fro displacement movement in alternating directions and a movement that is not a to-and-fro displacement movement in alternating directions. The to-and-fro movement of the distributor varies or regulates the pressure at which the rinsing liquid is supplied to the spray channels. More appropriately, the distributor has at least one opening for this purpose through which, in a certain position of the distributor, rinsing liquid can be supplied in a pressurised manner via one open end of the spray channel. If the opening is located before the open end of the spray channel, the pressurised rinsing liquid can enter into the spray channel in an unhindered manner through the distributor. When the opening is located adjacent to the open end of the spray channel as a result of a lateral displacement of the distributor, no rinsing liquid can enter into the spray channel through the distributor.

The to-and-fro movement of the distributor accordingly has the effect that the opening is either located completely or partly in front of the open end of the spray channel and thereby more or less rinsing liquid accordingly enters into the spray channel through the distributor. At the same time, the movement of the distributor can be adjusted in such a manner than the opening is located completely adjacent to the open end of the spray channel and thus no rinsing liquid enters into the spray channel through the distributor.

In a further preferred embodiment of the dishwasher with a spray device according to the present invention, a distributor is provided both at the first open end of the at least one spray channel and at the second open end of the at least one spray channel, regulating the supply of rinsing liquid to the spray channel. In this way, pressurised rinsing liquid can be supplied to the two ends of the tubular spray channel independently of one another. The supply of rinsing liquid to the spray channel is accomplished by a pumping device, such as the circulating pump of the dishwasher, for example.

More appropriately, the pressure at which the rinsing liquid is supplied to the spray channel via its one end or via its two ends is variable. As desired, the pressure for the supply of rinsing liquid via only one end of the spray channel or the pressure for the supply of rinsing liquid via both ends of the spray channel can be varied. For this purpose, it is especially advantageous if a number of spray channels is provided whose first open end is each coupled to a first distributor and whose second open end is each coupled to a second distributor. It is further advantageous if the pressure at which the rinsing liquid is supplied to the distributor or the distributors and then the spray channel is variable. A larger spectrum of spray patterns can thereby be produced.

Advantageously, at least one distributor can be driven to move preferably periodically by means of a drive. The to-and-fro movement of the distributor for example in alternating directions and therefore the position of the openings of the supply of rinsing liquid to the spray channels can thereby be exactly controlled. The drive is more appropriate a rotary disk and a cam disposed thereon which engages in a drive slot formed in the distributor.

In the configuration of the spray channel it has proved to be particularly advantageous if the spray channel is tubular and the openings for the passage of the rinsing liquid are constructed over a certain arc segment on the side of the spray channel directed towards the interior of the rinsing container. The spray jets can thereby emerge in different directions from the openings.

In order to configure the rinsing liquid as optimally as possible inside the rinsing container, the shape and/or the number of openings for the passage of the rinsing liquid and the spray patterns produced are preferably determined such that the desired rinsing is achieved in the interior of the rinsing container. In this case, a spray distribution which is as uniform as possible or a non-uniform spray distribution can be strived for where certain areas in the rinsing container can be rinsed more vigorously than others.

In a particularly advantageous embodiment of the dishwasher according to the invention, the rinsing container is constructed as trough-like and a number of spray channels aligned preferably parallel to one another is arranged in the bottom of the rinsing container. In principle, the number of spray channels is determined by the volume of the rinsing container or the area of the dishwasher base. The installation of a plurality of spray channels promotes a uniform spray distribution of the rinsing liquid in the rinsing container and prevents any "shading" of spray jets by the items to be rinsed. The bottom of the rinsing container can be shaped such that the spray channels lie on different planes and a plurality of spray planes is formed.

The spray channel can preferably be fixedly arranged by means of a clamping device in the bottom, top and/or wall area of the rinsing container. The spray channel can thereby be removed from the rinsing container if necessary to free it from deposits for example, or to replace it by another spray channel having different openings for the escape of rinsing liquid to obtain a different spray pattern.

The side of the spray channel directed towards the interior of the rinsing container can also be formed by the top, the wall and/or the bottom of the rinsing container, where the top, the wall and/or the bottom has openings for passage of the rinsing liquid in the area of the spray channel. In this embodiment, at least the side of the spray channel directed towards the interior of the rinsing container and the top, wall and/or bottom of the rinsing container is constructed in one piece. Since the rinsing containers are usually made of plastic, the openings for passage of the rinsing liquid can either be inserted subsequently or provided during manufacture of the rinsing container. In addition, the entire spray channel with the top, the wall and/or the bottom of the rinsing container can be constructed in one piece and provided with the manufacture of the rinsing container.

BRIEF DESCRIPTION OF THE DRAWINGS

The present invention is explained in detailed hereinafter using a preferred exemplary embodiment with reference to the appended drawing. The drawing shows a perspective view of a spray device such as can be used for example in a dishwasher according to the present invention.

DETAILED DESCRIPTION OF THE EXEMPLARY EMBODIMENTS OF THE PRESENT INVENTION

In the embodiment shown in the drawing, a plurality of tubular spray channels 3 are arranged substantially parallel to one another in the bottom 2 of the rinsing container 1. For a better overview the dimensions of the rinsing container 1 are indicated by the dashed lines. Openings 4 for passage of the rinsing liquid from the spray channel 3 into the interior of the rinsing container 1 are provided in the spray channels 3. The openings 4 are constructed on a certain arc segment on the side of spray channel directed towards the interior of the rinsing container so that spray jets (not shown) emerge in different directions from the openings 4. Since the openings 4 are distributed over the entire length of the spray channels 3, the possibility of the spray jets being "shaded" by items to be rinsed is reduced. Even if items to be rinsed are placed directly on the spray channel 3, spray jets can still emerge from the spray channel 3 into the rinsing container 1 at other positions.

The spray channels 3 each have two open ends wherein the open ends of the spray channels 3 on one side open into a first distributor 5 and the open ends of the spray channels 3 on the opposite end open into a second distributor. For a better overview the drawing shows only one distributor 5 which however has the same function and the same structure as the opposite distributor which is not shown.

The distributor 5 is arranged so that it can be moved and can be set in a periodic to-and-fro motion by means of a drive 7, 8, 9 in alternating directions which are indicated by the double arrow A in the drawing. The distributor 5 has a plurality of openings 6 through which rinsing liquid can enter into the spray channels 3 at certain positions of the distributor 5. The pressure and quantity of rinsing liquid supplied to the spray channels 3 is varied or regulated by the to-and-fro movement of the distributor 5. If an opening 6 is located in front of the open end of a spray channel 3, the pressurised rinsing liquid can enter into the spray channel 3 through the distributor 5 in an unhindered manner. If the opening 6 is located completely adjacent to the open end of the spray channel 3 as a result of a lateral displacement of the distributor 5, no rinsing liquid can enter into the spray channel 3 through the distributor 5.

The to-and-fro movement of the distributor 5 accordingly has the effect that the opening 6 is located either completely or partly in front of the open end of the spray channel 3 and thus more or less rinsing liquid enters into the spray channel 3 through the distributor 5. At the same time, the movement of the distributor 5 can be adjusted so that the opening 6 is located completely adjacent to the open end of the spray channel 3 and thus no rinsing liquid can enter into the spray channel 3 through the distributor 5. In this way, individual spray channels 3 or groups of spray channels 3 can be controlled separately, i.e. individual spray channels 3 or groups of spray channels 3 can be regulated by means of the distributor 5 in such a way that they jointly produce specific spray patterns. Furthermore, individual spray channels 3 or groups of spray channels 3 can be activated or deactivated, i.e. rinsing liquid can be supplied or the supply of rinsing liquid can be cut off.

The drive of the distributor 5 comprises a rotary disk 7 and a cam 8 located thereon which engages in a drive slot 9 constructed in the distributor 5. Whilst the rotary disk turns in one direction, the cam 8 accomplishes a vertical up-and-down movement in the drive slot 9 and effects a horizontal to-and-fro movement of the distributor 5 in the alternating directions of the double arrow A. The drive 7, 8, 9 can, for example, be operated by a separate electric motor or by an impeller driven by the flow of rinsing liquid. As a result of the to-and-fro movement of the distributor 5 operated by the drive 7, 8, 9, the position of the openings or the supply of rinsing liquid to the spray channels 3 can be exactly controlled.

The spray channels 3 can be arranged on the bottom 2 of the rinsing container 1 or integrated in the bottom 2 of the rinsing container 1. In this case, the spray channels 3 can be detachably affixed to the rinsing container 1, for example, by means of a clamping connection. It is thereby possible to remove the spray channels 3 if required to free them from deposits for example or to replace them by other spray channels 3.

However, it is also possible that the side of the spray channels 3 directed towards the interior of the rinsing container 1 is formed by the bottom 2 of the rinsing container 1 itself, where the bottom 2 has openings 4 for the passage of rinsing liquid in the area of the spray channels 3. In addition, the other walls of the spray channel 4 and therefore the spray channels 3 can all be constructed in one piece with the bottom 2 of the rinsing container 1, where the openings 4 for passage of the rinsing liquid are either inserted subsequently or provided during manufacture of the rinsing container 1.

Reference List

1 Rinsing container
2 Bottom of rinsing container
3 Spray channels
4 Openings for passage of the rinsing liquid from the spray channel 3
5 Distributor
6 Openings in the distributor 5 for the pressurised rinsing liquid
7 Rotary disk of the drive for the distributor 5
8 Cam on the rotary disk 7
9 Drive slot for engaging the cam 8
A Directions of movement of the distributor 5

The invention claimed is:

1. A dishwasher comprising at least one rinsing container having an interior in which items to be subjected to a dishwashing treatment are disposed; and a spray device for spraying rinsing liquid into the interior of the rinsing container, the spray device including at least one spray channel for guiding a rinsing liquid and at least one distributor for regulating the supply of rinsing liquid to the at least one spray channel, the at least one spray channel having, on a side directed towards the interior of the rinsing container, openings for the passage therethrough of the rinsing liquid and having two open ends via which rinsing liquid can be supplied in a pressurised manner.

2. The dishwasher according to claim 1, wherein the at least one distributor is mounted to be movable relative to the at least one spray channel in a selected one of a to-and-fro displacement movement in alternating directions and a movement that is not a to-and-fro displacement movement in alternating directions.

3. The dishwasher according to claim 2, wherein the at least one distributor has at least one opening through which rinsing liquid can be supplied in a pressurised manner via an open end of the spray channel in a predetermined position of the distributor.

4. The dishwasher according to claim 1, and further comprising another distributor, the at least one distributor being at the first open end of the at least one spray channel and the other distributor being provided at the second open end of the at least one spray channel and the at least one spray channel and the other distributor operating to regulate the supply of rinsing liquid to the spray channel.

5. The dishwasher according to claim 1, and further comprising another distributor and wherein the at least one spray channel is one of a plurality of spray channels each of which has a first open end coupled to the at least one distributor and a second open end coupled to the other distributor.

6. The dishwasher according to claim 2, and further comprising drive means for driving the at least one distributor in a periodic movement.

7. The dishwasher according to claim 6, wherein the at least one distributor includes a drive slot and the drive means includes a rotary disk and a cam arranged thereon, which engages in the drive slot formed in the at least one distributor.

8. The dishwasher according to claim 1, wherein the pressure at which the rinsing liquid is supplied to the spray channel is variable.

9. The dishwasher according to claim 1, wherein the at least one spray channel is tubular and the openings for the passage of rinsing liquid of the at least one spray channel are configured over a predetermined arc segment of the at least one spray channel on the side thereof directed towards the interior of the rinsing container.

10. The dishwasher according to claim 1, wherein the rinsing container is trough-shaped and the at least one spray channel is one of a plurality of spray channels that are aligned parallel to one another at least on the bottom of the rinsing container.

11. The dishwasher according to claim 1, further comprising:

a second distributor, wherein the at least one distributor is at the first open end of the at least one spray channel and the second distributor is at the second open end of the at least one spray channel, wherein the at least one distributor and the second distributor cooperate to regulate a quantity of rinsing liquid supplied to the spray channel and a pressure of the rinsing liquid in parts of the spray channel.

12. The dishwasher according to claim 1, wherein the at least one distributor is movable relative to the at least one spray channel in a to-and-fro displacement movement in alternating directions.

13. The dishwasher according to claim 12, and further comprising drive means for driving the at least one distributor in a periodic movement, wherein the at least one distributor includes a drive slot, and wherein the drive means includes:

a rotary disk; and a cam arranged on the rotary disk and engaging the drive slot formed in the at least one distributor.

14. A dishwasher comprising at least one rinsing container having an interior in which items to be subjected to a dishwashing treatment are disposed; and a spray device that sprays rinsing liquid into the interior of the rinsing container, the spray device including:

a plurality of spray channels that guide and spray a rinsing liquid into the interior of the rinsing container, the plurality of spray channels including openings for the passage therethrough of the rinsing liquid on a side directed towards the interior of the rinsing container, and two open ends into which rinsing liquid can be supplied; and a first plate-shaped distributor engaging a first open end of the two open ends of each of the plurality of spray channels, the first plate-shaped distributor selectively distributing the rinsing liquid to the first open end.

15. The dishwasher according to claim 14, wherein the first plate-shaped distributor selectively varies a quantity and a pressure of the rinsing liquid being supplied to the first open end of each of the plurality of spray channels.

16. The dishwasher according to claim 14, wherein the first plate-shaped distributor is movable in a to-and-fro displacement movement in alternating directions relative to the first open end of each of the plurality of spray channels.

17. The dishwasher according to claim 16, comprising:

drive means for driving the first plate-shaped distributor in the to-and-fro displacement movement in the alternating directions, wherein the first plate-shaped distributor includes a drive slot, and wherein the drive means includes:

a rotary disk; and a cam arranged on the rotary disk and engaging the drive slot formed in the first plate-shaped distributor.

18. The dishwasher according to claim 16, wherein the first plate-shaped distributor includes a plurality of openings selectively coupling with the first open end of each of the plurality of spray channels during the to-and-fro displacement movement.

19. The dishwasher according to claim 18, wherein the first plate-shaped distributor is selectively moveable in the to-and-fro displacement movement between a first position in which a first opening of the plurality of openings is completely aligned with the first open end of one of the plurality of spray channels, a second position in which the first opening of the plurality of openings is partially aligned with the first open end of the one of the plurality of spray channels, and a third position in which the first opening of the plurality of openings is completely not aligned with the first open end of the one of the plurality of spray channels.

20. A dishwasher comprising at least one rinsing container having an interior in which items to be subjected to a dishwashing treatment are disposed; and a spray device that sprays rinsing liquid into the interior of the rinsing container, the spray device including:

a plurality of spray channels that guide and spray a rinsing liquid into the interior of the rinsing container, the plurality of spray channels including openings for the passage therethrough of the rinsing liquid on a side directed towards the interior of the rinsing container, and two open ends into which rinsing liquid can be supplied; and a first plate-shaped distributor engaging a first open end of the two open ends of one of the plurality of spray channels, the first plate-shaped distributor selectively distributing the rinsing liquid to the first open end, wherein the first plate-shaped distributor is movable in a to-and-fro displacement movement in alternating directions relative to the first open end of the one of the plurality of spray channels, and wherein the first plate-shaped distributor includes a plurality of openings each selectively and respectively coupling with a plurality of first open ends of the two open ends of the plurality of spray channels during the to-and-fro displacement movement.

21. The dishwasher according to claim 14, comprising:

a second plate-shaped distributor engaging a second open end of the two open ends of each of the plurality of spray channels, the second plate-shaped distributor selectively distributing the rinsing liquid to the second open end of each of the plurality of spray channels, wherein the first plate-shaped distributor and the second plate-shaped distributor cooperate to regulate the quantity of rinsing liquid supplied to the plurality of spray channels and the pressure of the rinsing liquid in parts of each of the plurality of spray channels.

22. The dishwasher according to claim 21, wherein the second plate-shaped distributor selectively varies a quantity and a pressure of the rinsing liquid being supplied to the second open end of each of the plurality of spray channels.

23. The dishwasher according to claim 21, wherein the second plate-shaped distributor is movable in a to-and-fro displacement movement in alternating directions relative to the second open end of each of the plurality of spray channels.

24. The dishwasher according to claim 23, comprising:

drive means for driving the second plate-shaped distributor in the to-and-fro displacement movement in the alternating directions, wherein the second plate-shaped distributor includes a drive slot, and wherein the drive means includes:

a rotary disk; and a cam arranged on the rotary disk and engaging the drive slot formed in the second plate-shaped distributor.

25. The dishwasher according to claim 23, wherein the second plate-shaped distributor includes a plurality of openings selectively coupling with the second open end of each of the plurality of spray channels during the to-and-fro displacement movement.

26. The dishwasher according to claim 25, wherein the second plate-shaped distributor is selectively moveable in the to-and-fro displacement movement between a first position in which a first opening of the plurality of openings is completely aligned with the second open end of one of the plurality of spray channels, a second position in which the first opening of the plurality of openings is partially aligned with the second open end of the one of the plurality of spray channels, and a third position in which the first opening of the plurality of openings is completely not aligned with the second open end of the one of the plurality of spray channels.

27. A dishwasher comprising at least one rinsing container having an interior in which items to be subjected to a dishwashing treatment are disposed;

a spray device that sprays rinsing liquid into the interior of the rinsing container, the spray device including:

a plurality of spray channels that guide and spray a rinsing liquid into the interior of the rinsing container, the plurality of spray channels including openings for the passage therethrough of the rinsing liquid on a side directed towards the interior of the rinsing container, and two open ends into which rinsing liquid can be supplied; and a first plate-shaped distributor engaging a first open end of the two open ends of one of the plurality of spray channels, the first plate-shaped distributor selectively distributing the rinsing liquid to the first open end; and a second plate-shaped distributor engaging a second open end of the two open ends of the one of the plurality of spray channels, the second plate-shaped distributor selectively distributing the rinsing liquid to the second open end of the one of the plurality of spray channels, wherein the first plate-shaped distributor and the second plate-shaped distributor cooperate to regulate the quantity of rinsing liquid supplied to the plurality of spray channels and the pressure of the rinsing liquid in parts of each of the plurality of spray channels, wherein the second plate-shaped distributor is movable in a to-and-fro displacement movement in alternating directions relative to the second open end of the one of the plurality of spray channels, wherein the second plate-shaped distributor includes an opening selectively coupling with the second open end of the one of the plurality of spray channels during the to-and-fro displacement movement, wherein the second plate-shaped distributor is selectively moveable in the to-and-fro displacement movement between a first position in which the opening is completely aligned with the second open end of the one of the plurality of spray channels, a second position in which the opening is partially aligned with the second open end of the one of the plurality of spray channels, and a third position in which the opening is completely not aligned with the second open end of the one of the plurality of spray channels, and wherein the second plate-shaped distributor includes a plurality of openings each selectively and respectively coupling with the second open end of the two open ends of each of the plurality of spray channels during the to-and-fro displacement movement.

28. The dishwasher according to claim 14, wherein the plurality of spray channels are aligned parallel to one another at least on a bottom of the rinsing container.

29. The dishwasher according to claim 14, wherein the plurality of spray channels are one of formed in and arranged on one of a bottom of the rinsing container, a side of the rinsing container, and a top of the rinsing container.

30. The dishwasher according to claim 14, wherein the plurality of spray channels are one of formed in and arranged on each of a bottom of the rinsing container, a side of the rinsing container, and a top of the rinsing container.

31. The dishwasher according to claim 28, wherein the plurality of spray channels are parallel to each other.

32. The dishwasher according to claim 28, wherein a first spray channel of the plurality of spray channels lies in a first plane parallel to the bottom of the rinsing container, wherein a second spray channel of the plurality of spray channels lies in a second plane parallel to the bottom of the rinsing container, and wherein the first plane is different than the second plane.

* * * * *

UNITED STATES PATENT AND TRADEMARK OFFICE

CERTIFICATE OF CORRECTION

PATENT NO. : 8,528,574 B2
APPLICATION NO. : 10/578386
DATED : September 10, 2013
INVENTOR(S) : Jerg et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1442 days.

Signed and Sealed this
Fifteenth Day of September, 2015

Michelle K. Lee

Michelle K. Lee
*Director of the United States Patent and Trademark Office*